US009016313B2

(12) United States Patent
Shai et al.

(10) Patent No.: US 9,016,313 B2
(45) Date of Patent: Apr. 28, 2015

(54) REGULATION SYSTEM

(71) Applicants: Moti Shai, Studio City, CA (US); Shalom Shy, Studio City, CA (US)

(72) Inventors: Moti Shai, Studio City, CA (US); Shalom Shy, Studio City, CA (US)

(73) Assignee: Moti Shai, Studio City, CA (US)

( * ) Notice: Subject to any disclaimer, the term of this patent is extended or adjusted under 35 U.S.C. 154(b) by 0 days.

(21) Appl. No.: 14/020,779

(22) Filed: Sep. 6, 2013

(65) Prior Publication Data

US 2015/0068605 A1 Mar. 12, 2015

(51) Int. Cl.

| | |
|---|---|
| ***E03B 1/04*** | (2006.01) |
| ***F16K 11/16*** | (2006.01) |
| ***F16K 7/04*** | (2006.01) |
| ***E03C 1/02*** | (2006.01) |

(52) U.S. Cl.
CPC ..... *E03C 1/02* (2013.01)

(58) Field of Classification Search
USPC ..... 251/7; 137/607; 122/13.01, 13.3
See application file for complete search history.

(56) References Cited

U.S. PATENT DOCUMENTS

| | | | | |
|---|---|---|---|---|
| 1,801,847 | A * | 4/1931 | Carder et al. | 137/625.14 |
| 2,087,223 | A * | 7/1937 | Thompson | 137/636.2 |
| 2,301,439 | A * | 11/1942 | Moen | 137/636.1 |
| 2,607,600 | A * | 8/1952 | Trautman | 137/635 |
| 2,645,245 | A * | 7/1953 | Maisch | 137/565.35 |
| 2,715,010 | A * | 8/1955 | Reeves | 251/74 |
| 3,450,159 | A * | 6/1969 | Wilkin | 137/606 |
| 3,974,858 | A * | 8/1976 | Nielsen | 137/606 |
| 4,189,792 | A * | 2/1980 | Veach | 4/677 |
| 4,429,422 | A * | 2/1984 | Wareham | 4/676 |
| 4,563,780 | A * | 1/1986 | Pollack | 4/668 |
| 4,696,428 | A * | 9/1987 | Shakalis | 236/12.12 |
| 4,756,030 | A * | 7/1988 | Juliver | 4/668 |
| 4,786,028 | A * | 11/1988 | Hammond | 251/7 |
| 4,923,223 | A | 5/1990 | Seckel | |
| 4,945,943 | A * | 8/1990 | Cogger | 137/360 |
| 5,095,945 | A * | 3/1992 | Jensen | 137/607 |
| 5,184,642 | A * | 2/1993 | Powell | 137/607 |
| 5,287,570 | A * | 2/1994 | Peterson et al. | 4/626 |
| 5,975,421 | A | 11/1999 | Ito | |
| 6,148,146 | A * | 11/2000 | Poore et al. | 392/452 |
| 6,196,162 | B1 * | 3/2001 | Sparrowhawk | 122/13.3 |
| 6,662,384 | B1 | 12/2003 | Gardenier | |
| 2005/0072791 | A1 * | 4/2005 | Bauer | 222/1 |
| 2008/0189850 | A1 * | 8/2008 | Seggio et al. | 4/623 |
| 2012/0227681 | A1 * | 9/2012 | Min | 122/13.3 |

FOREIGN PATENT DOCUMENTS

WO WO 2011068313 A2 * 6/2011

* cited by examiner

*Primary Examiner* — John K Fristoe, Jr.
*Assistant Examiner* — Seth W Mackay-Smith

(57) ABSTRACT

A new method to deliver warm water to a bathroom by installing electric valve in the beginning of the hot line, instead of at the end. A new electronic faucet that may operated by remote control or electric switch.

1 Claim, 6 Drawing Sheets

The method [400]

REGULATION SYSTEM

CROSS-REFERENCE TO RELATED APPLICATIONS

Not applicable

RELATED CO-PENDING U.S. PATENT APPLICATIONS

Not applicable

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to regulation systems. More particularly, the invention relates to valves that help regulate water right where the line starts, e.g., not in the end of the tube line like all conventional valves.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that plumbing is the system of pipes, drains fittings, valves, valve assemblies, and devices installed in a building for the distribution of water for drinking, heating, washing, and the removal of waterborne wastes. Plumbing also describes the skilled trade of working with pipes, tubing, and plumbing fixtures in such systems.

Typically, a valve is a device that regulates, directs or controls the flow of fluids, such as gases, fluids, fluidized solids, or slurries, by opening, closing, or partially obstructing various passageways. Valve positions are operating conditions determined by the position of the disc or rotor in the valve. Some valves are made to be operated in a gradual change between two or more positions.

Often, heat transfer is a discipline of thermal engineering that concerns the transfer of thermal energy from one physical system to another. Heat transfer is classified into various mechanisms, such as heat conduction, convection, thermal radiation, and phase-change transfer. The heat from a fluid may be retained if stored in proximity to a source of thermal energy.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2A illustrates the hot fluid tube in an open position, and FIG. 2B illustrates the hot fluid tube in a closed position, in accordance with an embodiment of the present invention;

Unless otherwise indicated illustrations in the figures are not necessarily drawn to scale.

Figure 5:
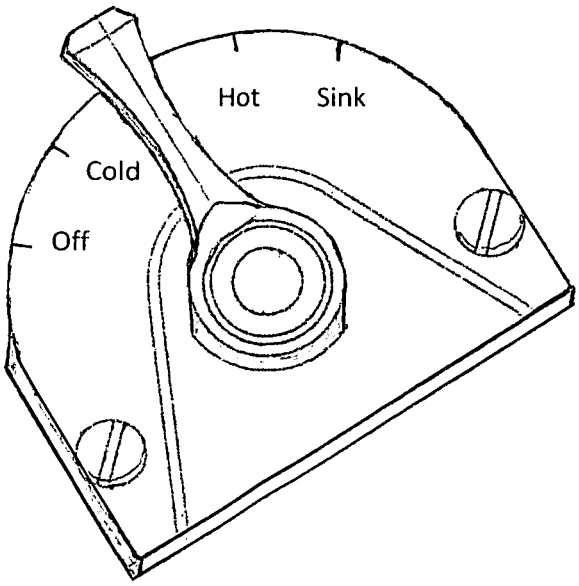

FIG. 5 illustrates of an exemplary rotary handle to control the flow, and the temperature.

Figure 6:
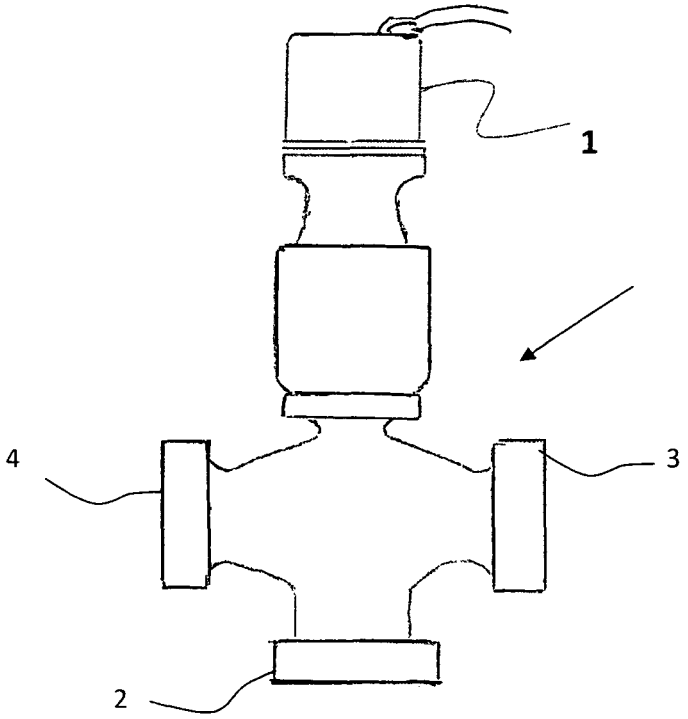

FIG. 6 illustrates of an exemplary tow way electric valve, to direct the flow accordance with an embodiment of the present invention.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

The present invention will now be described in detail with reference to embodiments thereof as illustrated in the accompanying drawings.

There are various types of regulation systems that may be provided by preferred embodiments of the present invention.

The present invention relates to valves that help regulate water right where the line starts, e.g., not in the end of the tube line like all conventional valves. The invention includes a new method to deliver warm water to a bathroom by installing electric valve in the beginning of the hot line, instead of at the end. There is also a new method for an electronic faucet. A new electronic faucet that may operated by remote control or electric switch. A rotary that resembles a faucet handle, which is controlled by pushing it to turn on and off. Turning the rotary to the left or right changes the temperature. A lever includes 4 positions, a (side) turn on/off; a neutral (middle) and up, turning on the hot water motor by relist it go to neutral—save it; and down by turning on the cold water motor by releasing it go to neutral to save it.

In one embodiment of the present invention, the regulation system may include a control portion that operatively controls at least one motor, which actuates at least two valves to regulate, direct, or control the flow of the fluid by opening, closing, or partially obstructing a fluid tube. The at least two valves helps regulate the temperature of a fluid passing through numerous fluid tubes. The system may help regulate the temperature of the fluid by providing at least two valves that restricts the flow of the fluid in proximity to a heating portion. The restricted fluid, being proximal to the heating portion, may then form a substantially hot fluid reservoir in a small area of the hot fluid tube. In this manner, the hot fluid is not stored in the hot fluid tube, at a distance from the heating portion where heat may dissipate and cooling occurs. But rather, the hot fluid stores in a section of the hot fluid tube that is in proximity to the heating portion for retaining thermal energy from the heating portion. In some embodiments, the remaining interior area of the hot fluid tube may be empty, thereby helping to save on fluid usage. Also, the hot fluid stored in a hot portion of the tubing system may allow the hot fluid to disperse at a higher temperature almost instantaneously since cooler water is not present in the tubes. The at least two valves may also regulate a cold fluid tube to provide a desired amount of cold fluid for mixing with the hot fluid and final dispersal. In this manner, the position of the valves can be utilized to provide warm fluid, or any desired temperature.

In one embodiment of the present invention, at least one motor may power the at least one valve. The at least one motor may power the at least one valve to physically press against the hot fluid tube by bending, or crimping the hot fluid tube at a point along the hot fluid tube that is in proximity to the heating portion. In one embodiment, the at least two valves may include tow V-braces, one under the lexical tube, and one above the lexical tube, that presses onto a tube for restricting the flow of the fluid. The at least one motor may also power the at least one valve to regulate the cold water tube. In some embodiments, a control portion may operatively regulate the at least one valves to allow the hotfluid to flow through the hot fluid tube and disperse through at least one dispersion tube. The control portion may also regulate the at least one motor to operate the at least two valves to allow the flow of a cold fluid for dispersion alone, or in conjunction with the hot fluid. In yet another embodiment, the control portion may simultaneously regulate the at least two valves to simultaneously allow a predetermined flow of the hot fluid and the cold fluid through the at least one dispersion tube to allow the flow of a warm fluid, or to regulate the individual water presser temperatures of the hot fluid and the cold fluid.

Figure 1:
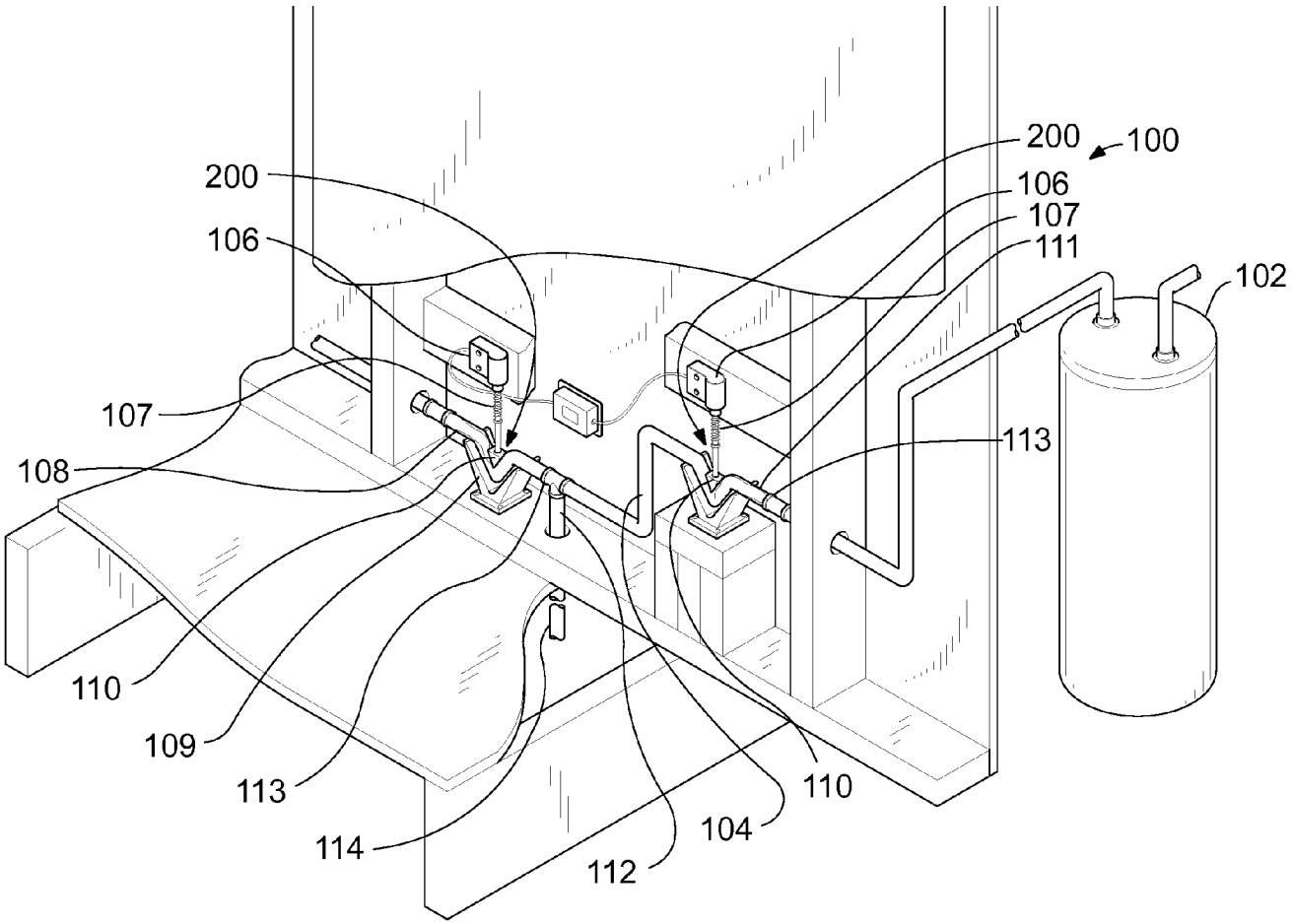
FIG. 1 illustrates a detailed perspective view of an exemplary regulation system, in accordance with an embodiment of the present invention.

FIG. 1 illustrates a detailed perspective view of an exemplary regulation system, in accordance with an embodiment of the present invention. In the present embodiment, a regulation system 100 may include a control portion that controls at least one motor, which functions to actuate at least two valves for regulating, directing, or controlling the flow of the fluid by opening, closing, or partially obstructing a fluid tube. In some embodiments, the regulation system includes at least two valves 110 that help regulate the temperature of a fluid passing through numerous fluid tubes. The system may help regulate the temperature of the fluid by providing at least two valves that restricts the flow of the fluid in proximity to a heating portion 102; thereby creating a substantially hot fluid reservoir in a small area and in proximity to the heating portion. In this manner, the substantially hot fluid is not stored in a hot fluid tube 104, at a distance from the heating portion where cooling may occur. But rather, the hot fluid stores in a section of the hot fluid tube that is in proximity to the heating portion for retaining thermal energy from the heating portion. The remaining interior area of the hot fluid tube may be empty, thereby helping to save on fluid usage. The at least two valves may also regulate a cold fluid tube to provide a desired amount of cold fluid for mixing with the hot fluid and final dispersal. In this manner, the position of the valves can be utilized to provide warm fluid, or any desired temperature.

Those skilled in the art, in light of the present teachings, will recognize that the hot fluid stored in a hot section of the tubing system may allow the fluid to disperse at a higher temperature, almost instantaneously since cooler water is not present in the tubes. The fluid may include, without limitation, water, fluidized solids, slurries, gases, and gels. For example, without limitation, the regulation system may initiate from a water heater in an attic of a home. Both the hot fluid tube and the cold fluid tube may be sloped down such that the fluid does not accumulate in the pipe after valve is shut off. In one alternative embodiment, a warm fluid tube may position farther from the heating portion than the hot fluid tube, yet closer to the heating portion than the cold fluid tube.

In one embodiment of the present invention, at least one motor 106 may power the at least one valve. The at least one motor may power the at least one valve to physically press against the hot fluid tube by bending, or crimping the hot fluid tube at a point along the hot fluid tube that is in proximity to the heating portion. The at least one motor may include, without limitation, a low voltage switch box, low voltage mini motor, similar to motors that power automobile windows. In another embodiment, the at least one motor may be controlled remotely by a remote control box. The at least one motor may be powered by, without limitation, a battery, and/or an external power source. In one embodiment, the at least two valves may include tow V-braces each, that presses the hot fluid tube and/or a cold fluid tube 108 for restricting the flow of the fluid. The at least one motor may also power the at least one valve to regulate the cold water tube. In some embodiments, a control portion may operatively regulate the at least two valves to allow the hot fluid to flow through the hot fluid tube and disperse through at least one dispersion tube 112. The at least one dispersion tube may provide a junction point for the hot fluid tube and the cold fluid tube. The at least one dispersion tube may include, without limitation, a shower pipe, a sink pipe, and a kitchen appliance pipe. In some embodiments, the combination of tubes may form a plumbing and fluid distribution system. In some embodiments, the hot fluid tube and the cold fluid tube may include any system configured to carry a fluid, including, without limitation, two 6" long flex tubes made from silicon or rubber, hot and cold. The tow flex tubes connected with couplings to copper T, the copper T connected to pipe line, that end by the shower had, or connected to a tow way electric valve under the sink. The pipe line may be made of copper, a flexible irrigation pipe, a ½" flexible tube, or a PVC pipe a low density polymer tube.

The control portion may simultaneously regulate the at least two valves to simultaneously allow a predetermined flow of the hot fluid and the cold fluid through each dispersion tube. In this manner, a warm fluid may be formed, and the individual temperatures of the hot fluid and the cold fluid may be regulated. The control portion may include a plurality of switches for controlling the at least two motor. In one embodiment, the regulation system may include a kit for installing into a plumbing system. The kit may include, without limitation, tubes, couplers, one valve assemblies, a control box, one motor, and wiring. In this manner, the regulation system may be detachably joined to any house with slop roof. The regulation system may install near the water heater connect to the hot plumbing system and end in the shower had, or connected to a two way electric valve under the sink. In this embodiment, the shower receives cold water from the shower faucet, and hot water direct from the water heater by turning electric switch in the shower.

Figure 2A:
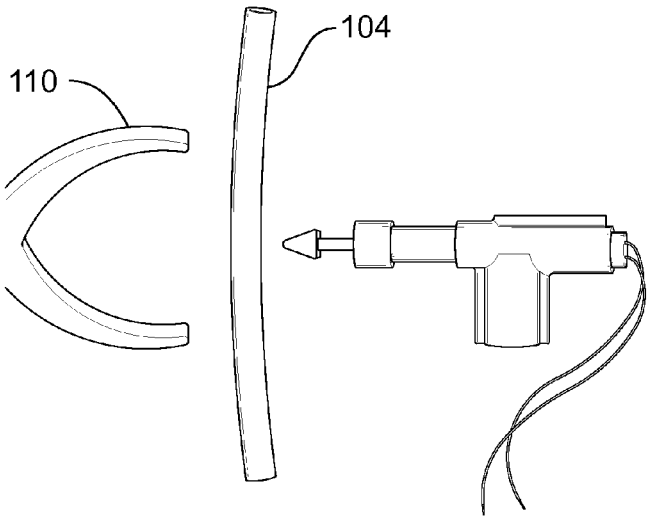
FIGS. 2A and 2B illustrate top views of an exemplary at least two valves restricting an exemplary hot fluid tube, where
Figure 2B:
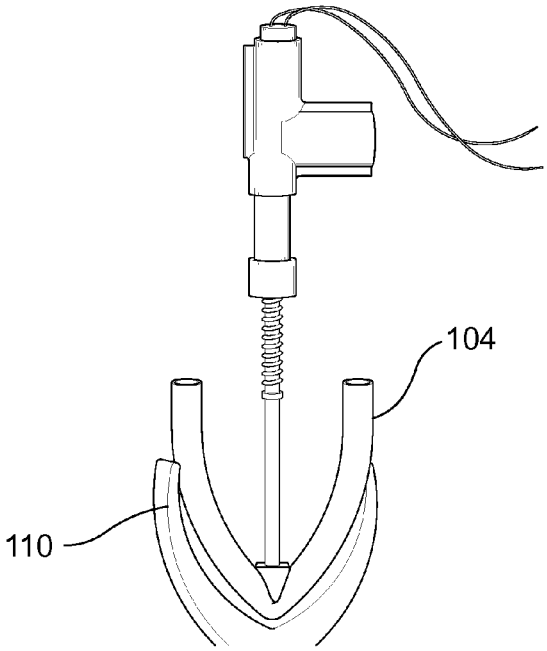

FIGS. 2A and 2B illustrate top views of exemplary at least two valves restricting an exemplary hot fluid tube, where FIG. 2A illustrates the hot fluid tube in an open position, and FIG. 2B illustrates the hot fluid tube in a closed position, in accordance with an embodiment of the present invention. In the present embodiment, the at least two valves may utilize different mechanisms for restricting the tubes, including, without limitation, hydraulic valve, pneumatic valve, manual valve, solenoid valve, motor valve. Those skilled in the art, in light of the present teachings, will recognize that the thickness of the tube dictates the compressive force generated by the at least two valves.

In one embodiment of the present invention, the system may help regulate a hot fluid by providing at least one valve that restricts the flow of the hot fluid in proximity to a heating portion. The restricted hot fluid, being proximal to the heating portion, may then form a hot fluid reservoir in a small area of the hot fluid tube. Upon command from the control portion, the at least one motor may force the at least one valve to release the hot fluid to flow to the at least one dispersion tube. Those skilled in the art, in light of the present teachings, will recognize that if the hot fluid rests in a tube for a duration, the heat will dissipate; thereby resulting in a warm or cold fluid dispersion for a period of time until the hot fluid arrives through the tubes from the heating portion. In some embodiments, the temperature of the fluid that disperses through the at least one dispersion tube may be dictated by the amount of restriction that the at least one valve applies to the respective fluid tube. In this manner, the pressure applied to each valve regulates the final temperature of the fluid from the dispersion tube.

Figure 3:
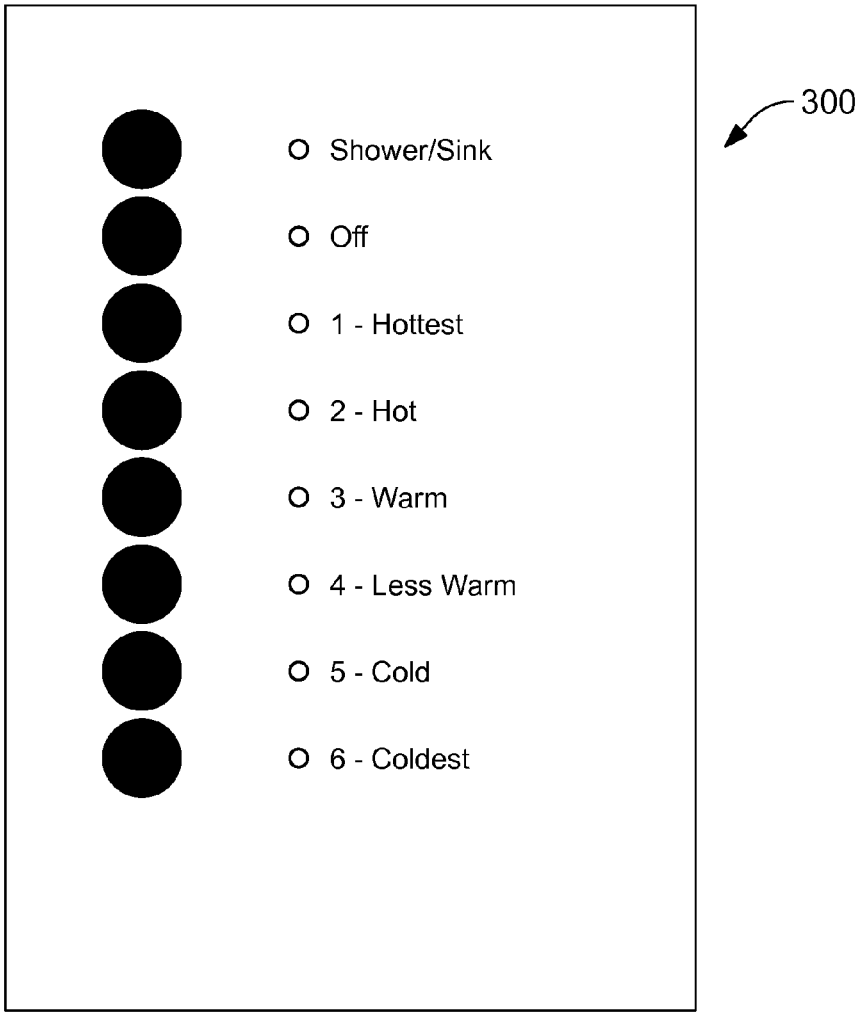
FIG. 3 illustrates a top view of an exemplary control portion, in accordance with an embodiment of the present invention.

FIG. 3 illustrates a top view of an exemplary control portion, in accordance with an embodiment of the present invention. In the present embodiment, a control portion 300 may regulate the at least one motor to operate the at least two valves to allow the flow of the cold fluid for dispersion alone, or in conjunction with the hot fluid. In some embodiments, the control portion may include a rotary, configured to resemble a faucet handle, and operable to be pushed on/off, and turned left to regulate the temperature of the fluid by controlling the at least two valves. For example, without limitation, a lever may include 4 positions. A side to side position 1 turns the flow of fluid on and off. A neutral position 2 allows the regulation system to rest. An up position 3 actuates the at least one motor for the hot fluid. A down position 4 actuates the at least one motor for the cold fluid. In some embodiments, a short flexible pipe has coupling connection in both ends.

In yet another embodiment, the control portion may simultaneously regulate the at least two valves to simultaneously allow a predetermined flow of the hot fluid and the cold fluid through the at least one dispersion tube. In this manner, a warm fluid may be formed, and the individual temperatures of the hot fluid and the cold fluid may be regulated. The control portion may include a plurality of switches for controlling the at least one motor. For example, without limitation, the plurality of switches may include buttons having the options of: On/Off, Sink/Shower, Hot, Hottest, Warm, Less Warm, Cold, and Coldest. Each temperature may comprise a range determined by the combinative effects of the hot fluid and the cold fluid.

Figure 4:
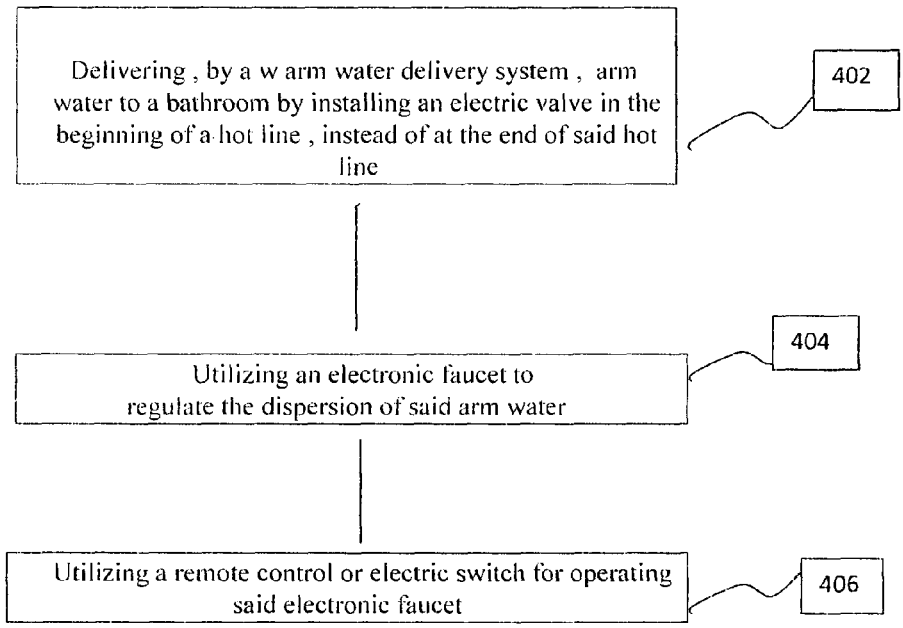
FIG. 4 illustrates a flowchart of an exemplary regulation method, in accordance with an embodiment of the present invention.

FIG. 4 illustrates a flowchart of an exemplary regulation method, in accordance with an embodiment of the present invention. In the present embodiment, a method 400 for regulation may include steps for controlling the flow of warm water through a new, electronic faucet. A first Step 402 includes delivering, by a warm water delivery system, warm water to a bathroom by installing an electric valve in the beginning of a hot line, instead of at the end of said hot line. A second Step 404 includes utilizing an electronic faucet to regulate the dispersion of said warm water. A final Step 406 includes utilizing a remote control or electric switch for operating said electronic faucet. In some embodiments, the method delivers warm water to a bathroom by installing electric valve in the beginning of the hot line, instead of at the end. The method also comprises an electronic faucet. The electronic faucet may be operated by remote control or electric switch. A rotary that resembles a faucet handle, which is controlled by pushing it to turn on and off. In one embodiment, turning the rotary to the left or right changes the temperature. A lever having 4 positions, a (side) turn on/off; a neutral (middle) and up, turning on the hot water motor by relist it go to neutral—save it; and down by turning on the cold water motor by releasing it go to neutral to save it.

In one alternative embodiment, the at least two valves may restrict the hot fluid for a duration until a second, differently composed fluid mixes with the hot fluid, thereby forming a commixture of a different composition. In yet another alternative embodiment, the at least two valves may include a plurality of apertures in the tubes that open and close to provide a more precise restriction and release of the fluid. In yet another alternative embodiment, the fluid may include a gas and/or a fluid. In yet another alternative embodiment, various pressures may be applied to the restricted fluid in the tube to change the chemical composition of the fluid. In one alternative embodiment, the heating portion may provide thermal energy from a solar panel. In yet another alternative embodiment, the regulation system may include a plurality of tubes that join from a plurality of buildings, whereby a master controller regulates the valves and dispersion sequences.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A method of controlling liquid flow to a bathroom, the method comprising steps of:

Controlling hot and cold water from a hot water supply and a cold water supply to a desired temperature using electric V-tube compressor valves installed at an outlet of a water heater and on a cold water line, respectively;

effecting said control utilizing a turning handle wherein said turning handle is moved between an "on" position and an "off" position by pushing or pulling said turning handle;

wherein the turning handle causes the desired temperature to vary when turned from side to side and the turning handle causes the valves to restrict or allow flow such that the desired temperature is reached when the hot and cold water are mixed;

mixing the hot and cold water from said valves, and delivering the mix to the bathroom and insuring that the water drains when the valves are not in use;

wherein the mixed water is delivered and proper drainage of the hot and cold water is insured by installing a delivery pipe between said valves and the bathroom, a sloping installation angle being maintained from the valves to an outlet in the bathroom such that the delivery pipe empties of water when the handle is "off", thus closing the valves and allowing said drainage.

* * * * *